US009687893B2

(12) United States Patent
Yoshiyama

(10) Patent No.: US 9,687,893 B2
(45) Date of Patent: Jun. 27, 2017

(54) MANUFACTURING METHOD OF MARTENSITE-BASED STAINLESS STEEL FOR EDGED TOOLS

(71) Applicant: HITACHI METALS, LTD., Tokyo (JP)

(72) Inventor: Goh Yoshiyama, Shimane (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/781,197

(22) PCT Filed: Mar. 18, 2014

(86) PCT No.: PCT/JP2014/057249

§ 371 (c)(1),
(2) Date: Sep. 29, 2015

(87) PCT Pub. No.: WO2014/162865

PCT Pub. Date: Oct. 9, 2014

(65) Prior Publication Data

US 2016/0052031 A1 Feb. 25, 2016

(30) Foreign Application Priority Data

Apr. 1, 2013 (JP) ..... 2013-075816

(51) Int. Cl.
*B21B 3/02* (2006.01)
*B21B 27/02* (2006.01)
(Continued)

(52) U.S. Cl.
CPC ..... *B21B 3/02* (2013.01); *B21B 1/22* (2013.01); *B21B 27/06* (2013.01); *C22C 38/04* (2013.01);
(Continued)

(58) Field of Classification Search
CPC .. B21B 3/02; B21B 1/22; B21B 27/06; B21B 27/021; B21B 2001/221; B21B 27/10; B21B 1/28
See application file for complete search history.

(56) References Cited

U.S. PATENT DOCUMENTS 5,463,801 A * 11/1995 Kajiwara ..... B21B 1/28 118/419
9,156,174 B2 * 10/2015 Gratsias ..... B26B 21/227
(Continued)

FOREIGN PATENT DOCUMENTS

CN 1303914 7/2001
CN 1318438 10/2001
(Continued)

OTHER PUBLICATIONS

Merged copy of JP10277604A to Yamamoto is attached.*
(Continued)

*Primary Examiner* — Peter DungBa Vo
*Assistant Examiner* — John S Lowe
(74) *Attorney, Agent, or Firm* — Rankin, Hill & Clark LLP

(57) ABSTRACT

There is provided a manufacturing method of martensite-based stainless steel for edged tools, which can decrease the number of passes during final cold rolling thereby to improve productivity. In the manufacturing method of martensite-based stainless steel for edged tools having a thickness of 0.1 mm or less by cold rolling, the final cold rolling is performed under condition of a diameter of a work roll of 100 to 130 mm, a cold rolling speed of more than 120 and not more than 200 m/min, and a lubricating oil viscosity of 30 to 40 $mm^2/s$. Preferably, the cold rolling speed is 150 to 190 m/min, and the lubricating oil viscosity is 33 to 39 $mm^2/s$.

5 Claims, 1 Drawing Sheet

(51) Int. Cl.

| | |
|---|---|
| ***B21B 1/22*** | (2006.01) |
| ***B21B 27/06*** | (2006.01) |
| ***C22C 38/04*** | (2006.01) |
| ***C22C 38/22*** | (2006.01) |

(52) U.S. Cl.
CPC ..... *C22C 38/22* (2013.01); *B21B 27/021* (2013.01); *B21B 2001/221* (2013.01)

(56) References Cited

U.S. PATENT DOCUMENTS

2008/0087066 A1* 4/2008 Takahama ..... B21B 1/28
72/45
2012/0321501 A1* 12/2012 Chae ..... B22D 11/002
420/42

FOREIGN PATENT DOCUMENTS

| | | | | |
|---|---|---|---|---|
| GB | 2258469 | A1 | | 2/1993 |
| JP | 5039547 | A2 | | 2/1993 |
| JP | 6015308 | A2 | | 1/1994 |
| JP | 6145907 | A2 | | 5/1994 |
| JP | 9-76003 | | | 3/1997 |
| JP | 10277604 | A | * | 10/1998 |
| JP | 2001240888 | A2 | | 9/2001 |

OTHER PUBLICATIONS

Machine translation JP10277604 A to Yamamoto is attached.*
International Search Report dated Apr. 15, 2014 filed in PCT/JP2014/057249.
Extended European Search Report dated Dec. 2, 2016 issued in the corresponding European patent application No. 147790372.

* cited by examiner

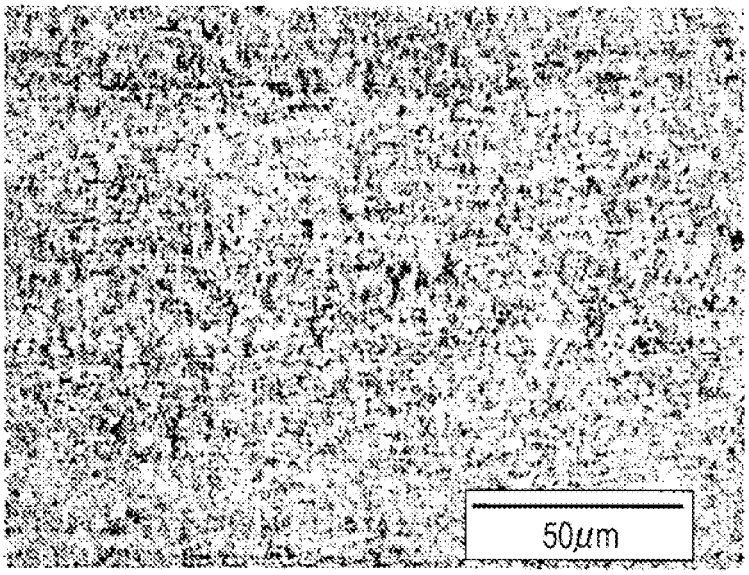
50μm

MANUFACTURING METHOD OF MARTENSITE-BASED STAINLESS STEEL FOR EDGED TOOLS

TECHNICAL FIELD

The present disclosure relates to a manufacturing method of martensite-based stainless steel for edged tools.

BACKGROUND ART

For example, stainless steel for edged tools used in razors having a thickness of 0.1 mm or less is required to have high hardness and corrosion resistance. Consequently, 13% by mass Cr steel containing 0.5 to 1.0% by mass of C is often used. The present applicant has also proposed, for example, inventions of steel for stainless razors in JP-A-5-039547 (Patent Literature 1) and JP-A-6-145907 (Patent Literature 2).

It is noted that, for example, martensite-based stainless steel used in razors or the like is martensite-based stainless steel for edged tools which has been hot-rolled to a required thickness and subsequently subjected to cold rolling and annealing in a repeated manner. Then, for manufacturing edged tools such as razors, punching into a razor shape, for example, is performed. Therefore, the above-described martensite-based stainless steel for edged tools needs to have hardness of 270 to 360 HV.

CITATION LIST

Patent Literature

PATENT LITERATURE 1: JP-A-5-039547
PATENT LITERATURE 2: JP-A-6-145907

SUMMARY OF INVENTION

Problems to be Solved by the Invention

For adjusting the hardness of the above-described mar martensite-based stainless steel for edged tools, cold rolling is repeatedly performed so that the final hardness is obtained. When a work roll having a small diameter is used for the cold rolling, the cold rolling of high reduction can be performed. However, this destabilizes the shape in a plate thickness cross section. Consequently, a work roll having a large diameter (hereinafter, referred to as a large-diameter roll) needs to be used, thereby disabling the cold rolling of high reduction. Accordingly, the number of passes performed during one cycle of the cold rolling naturally increases.

In particular, the large-diameter roll is used in final rolling for flattening the shape of an adjusted final product. Consequently, an increase in the number of passes becomes a hindrance to improved productivity. Furthermore, the large-diameter roll wears earlier. Thus, if the number of passes performed in the final cold rolling can be decreased, and the shape of a product is not changed from that of martensite-based stainless steel for edged tools known in the art, productivity can increase.

An object of the present disclosure is to provide a manufacturing method of martensite-based stainless steel for edged tools which can decrease the number of passes during the final cold rolling and improve productivity.

Solutions to the Problems

The present inventor has intensively conducted research on the condition during cold rolling in order to provide a form in which the number of passes performed during final cold rolling can be decreased, and a final product shape is equal to that in a step known in the art. As a result, the present inventor found that while stabilizing the product shape using a large-diameter roll, the number of passes performed during final cold rolling can be decreased by adjusting the cold rolling speed and the viscosity of lubricating oil to improve a rolling reduction ratio. Thus, the present disclosure has been achieved. Therefore, the present disclosure is a manufacturing method of martensite-based stainless steel for edged took having a thickness of 0.1 mm or less, including performing final cold rolling under condition of a diameter of a work roll of 100 to 130 mm, a cold rolling speed of more than 120 and not more than 200 m/min, and a lubricating oil viscosity of 30 to 40 $mm^2/s$.

In the manufacturing method of martensite-based stainless steel for edged tools, preferably, the cold rolling speed is 150 to 190 m/min, and the lubricating oil viscosity is 33 to 39 $mm^2/s$.

In the manufacturing method of martensite-based stainless steel for edged tools, preferably, hardness after the final cold rolling is 280 to 340 HV.

Effects of the Invention

According to the present disclosure, the number of passes in the final cold rolling can be decreased, and hardness of 280 to 340 HV which is equal to that of a material known in the art can be obtained. Therefore, productivity can be improved.

BRIEF DESCRIPTION OF THE DRAWINGS

The FIGURE is a surface micrograph of martensite-based stainless steel for edged tools obtained in the present disclosure.

DESCRIPTION OF EMBODIMENTS

The present disclosure has its greatest characteristics in that the cold rolling condition described below is selected in a manufacturing method of martensite-based stainless steel suitably used in razors or the like for achieving a thickness of 0.1 mm or less by cold rolling.

In processes other than final cold rolling, the use of a work roll having a small diameter (hereinafter, referred to as a small-diameter roll) can increase rolling reduction ratios, thereby improving productivity. However, since a large-diameter roll is used in the final cold rolling for inhibiting a product shape from being unstable, the number of passes has been required to be increased. However, according to the present disclosure, the number of passes can be decreased even in the final cold rolling. The present disclosure will be described in detail below.

Diameter of work roll: 100 to 130 mm

As described above, the thickness and the product shape of martensite-based stainless steel for edged tools need to be adjusted with the large-diameter roll in the final rolling. The diameter of the work roll necessary for achieving this is 100 to 130 mm. When the diameter of the work roll is less than 100 mm, the shape of the surface is unstable. This is particularly significant for a wide-width material, such as when the martensite-based stainless steel for edged took has a width of more than 700 mm. For this reason, the lower limit of the diameter of the work roll is defined as 100 mm. The lower hunt of the diameter of the work roll is preferably 105 mm, and further preferably 110 mm. Furthermore, the diameter of the work roll, which is exceeds 130 mm, leads to an increase in the number of passes even when the cold rolling speed and the lubricating oil viscosity described later are adjusted. Thus, the effect of reducing the number of passes in the final cold rolling becomes insufficient. For this reason, the upper limit of the diameter of the work roll is defined as 130 mm. The upper limit of the diameter of the work roll is preferably 125 mm, and further preferably 120 mm.

Cold rolling speed: more than 120 and not more than 200 m/min, lubricating oil viscosity 30 to 40 $mm^2/s$.

The adjustment of the cold rolling speed and the lubricating oil viscosity as defined in the present disclosure can reduce mill load. Consequently, even the use of the large-diameter roll with a diameter of 100 to 130 mm described above can increase a rolling reduction ratio. In particular, the use of the large-diameter roll for performing rolling inevitably increases a contact area between the surface of a roll and the surface of martensite-based stainless steel for edged tools to be rolled, due to a large radius of curvature of the large-diameter roll. Accordingly, mill load also increases. For this reason, defining an appropriate lubricating oil viscosity and an appropriate cold rolling speed is particularly required when the large-diameter roll is used for rolling.

In the cold rolling, the cold rolling speed of the martensite-based stainless steel for edged took is not the same as the speed of the outer circumference of the roll during cold rolling. This causes slippage to occur between the surface of the martensite-based stainless steel for edged tools and the surface of the roll during cold rolling. For generating desired slippage between the surface of the martensite-based stainless steel for edged tools and the surface of the roll, lubricating oil is indispensable. When the lubricating oil has a low viscosity, oil film shortage occurs during rolling. This deteriorates slippage and increases mill load. For preventing this, the lower limit of the lubricating oil viscosity is defined as 30 $mm^2/s$. The lower limit is preferably 33 $mm^2/s$, and further preferably 35 $mm^2/s$. On the contrary, a high lubricating oil viscosity increases incorporation of lubricating oil and causes oil film shortage to be unlikely to occur. However, the occurrence of telescoping during the winding-up of the martensite-based stainless steel for edged tools after the final rolling causes coils to break. For preventing this, the upper limit of the lubricating oil viscosity is defined as 40 $mm^2/s$. The upper limit is preferably 39 $mm^2/s$, and further preferably 38 $mm^2/s$.

Also, large load is applied to the surface of the rolled martensite-based stainless steel for edged tools from the surface of the rolling roll. Consequently, a slow cold rolling speed decreases the amount of the lubricating oil incorporated between the surface of the rolled martensite-based stainless steel for edged tools and the surface of the rolling roll. This causes oil film shortage to be likely to occur, and increases mill load. To address this concern, the lower limit of the cold rolling speed is defined as more than 120 m/min. The lower limit is preferably 150 m/min.

On the contrary, a fast cold rolling speed increases incorporation of lubricating oil and causes oil film shortage to be unlikely to occur. However, the occurrence of telescoping during the winding-up of the martensite-based stainless steel for edged tools after the final rolling causes coils to break. For preventing this, the upper limit of the cold rolling speed is defined as 200 m/min, and preferably 190 m/min.

In the present disclosure, the hardness after the final cold rolling is defined as 280 to 340 HV in terms of Vickers hardness. Within this range, the occurrence of shear droop can be inhibited when punching the martensite-based stainless steel for edged tools obtained by the manufacturing method according to the present disclosure. The hardness is preferably 290 to 320 HV.

It is noted that the martensite-based stainless steel for edged tools as described in the present disclosure is Fe-based alloy typically containing, for example, as indispensable components, 0.3 to 1.5% of C, 10 to 18% of Cr, 1% less of Si, and 1.5% or less of Mn, and if necessary, 3% or less of Mo, 1% or less of Ni, 1% or less of V, 0.001% or less of B, or 0.2% or less of N, in terms of % by mass.

Example

Ten coils of an intermediately cold-rolled material having a thickness of 0.121 mm before final cold rolling were prepared by repeatedly cold rolling and annealing a hot-rolled material of martensite-based stainless steel for edged tools having a thickness of 2.0 mm as illustrated in Table 1.

TABLE 1

| (mass %) | | | | |
|---|---|---|---|---|
| C | Si | Mn | Cr | Remainder |
| 0.65 | 0.27 | 0.67 | 13.25 | Fe and unavoidable impurities |

All of the above-described 10 coils were subjected to final cold rolling for achieving a final thickness of 0.1 mm. Coils No. 1 to 6 were examples of the present disclosure; three coils of the remaining four coils were comparative examples; and one coil was a conventional example.

Table 2 illustrates diameters of large-diameter rolls, cold rolling speeds and lubricating oil viscosities used in the final cold rolling.

TABLE 2

| NO. | Diameter of large-diameter roll (mm) | Cold rolling speed (m/min) | Lubricating oil viscosity ($mm^2/s$) | Number of passes | Remarks |
|---|---|---|---|---|---|
| 1 | 120 | 180 | 37 | 1 | Present disclosure |
| 2 | 130 | 180 | 37 | 1 | Present disclosure |
| 3 | 120 | 125 | 37 | 1 | Present disclosure |
| 4 | 120 | 195 | 37 | 1 | Present disclosure |
| 5 | 120 | 180 | 31 | 1 | Present disclosure |
| 6 | 120 | 180 | 39 | 1 | Present disclosure |
| 7 | 120 | 180 | 20 | 2 | Comparative example |
| 8 | 120 | 215 | 37 | — | Comparative example |
| 9 | 120 | 120 | 37 | 1 | Comparative example |
| 10 | 120 | 120 | 20 | 1 | Comparative example |

Final cold rolling was performed under the conditions illustrated in Table 2. As a result, the number of passes performed for achieving a final thickness of 0.1 mm was one in examples of the present disclosure. In contrast to this, the number of passes in the comparative examples was two. Thus, the number of passes in the examples of the present disclosure could be reduced in half.

It is noted that in coil No. 8 of Table 2, telescoping occurred during cold rolling, and the cold rolling was therefore interrupted on the way. Also, in coil No. 7 as the conventional example, oil shortage was likely to occur, and therefore, the number of passes was defined as two. In coils Nos. 9 and 10 as the comparative examples, oil shortage occurred during cold rolling as expected.

The surface of the martensite-based stainless steel for edged tools according to the examples of the present disclosure was grossless (dull-like) metal skin as illustrated in the FIGURE. While the martensite-based stainless steel for edged tools according to the examples of the present disclosure had hardness or 298 to 302 HV, the martensite-based stainless steel for edged tools according to the conventional example had hardness of 305 HV. In this manner, the martensite-based stainless steel for edged tools according to the examples of the present disclosure was comparable to the martensite-based stainless steel for edged tools according to the conventional example, in terms of both the surface shape and the hardness.

As described above, when the manufacturing method of martensite-based stainless steel for edged tools according to the present disclosure is applied, the number of passes in the final cold rolling can be drastically reduced compared to the conventional art. Consequently, not only productivity can be improved, but also the wear of the large-diameter roll can be reduced. Therefore, even a life of the large-diameter roll can be improved.

The invention claimed is:

1. A manufacturing method of martensite-based stainless steel for edged tools having a thickness of 0.1 mm or less, comprising:

performing final cold rolling of the martensite-based stainless steel for edged tools under condition of a diameter of a work roll of 100 to 130 mm, said cold rolling having a cold rolling speed of more than 120 and not more than 200 m/min, and applying a lubricating oil having a viscosity of 30 to 40 mm2/s to said cold rolling step.

2. The manufacturing method of martensite-based stainless steel for edged tools according to claim 1, wherein the cold rolling speed is 150 to 190 m/min, and the lubricating oil viscosity is 33 to 39 $mm^2/s$.

3. The manufacturing method of martensite-based stainless steel for edged tools according to claim 1, wherein hardness after the final cold rolling is 280 to 340 HV.

4. The manufacturing method of martensite-based stainless steel for edged tools according to claim 2, wherein hardness after the final cold rolling is 280 to 340 HV.

5. The manufacturing method of martensite-based stainless steel for edged tools according to claim 1, wherein the martensite-based stainless steel for edged tools comprises 0.3 to 1.5% by mass of C, 10 to 18% by mass of Cr, 1% by mass or less of Si, 1.5% by mass or less of Mn, 0 to 3% by mass of Mo, 0 to 1% by mass of Ni, 0 to 1% by mass of V, 0 to 0.001% by mass of B, 0 to 0.2% by mass of N, and remainder Fe and unavoidable impurities.

* * * * *